United States Patent [19]

Sawada et al.

[11] Patent Number: 4,617,257

[45] Date of Patent: Oct. 14, 1986

[54] HEAT DEVELOPABLE LIGHT-SENSITIVE MATERIAL

[75] Inventors: Satoru Sawada; Toshinao Ukai, both of Kanagawa, Japan

[73] Assignee: Fuji Photo Film Co., Ltd., Kanagawa, Japan

[21] Appl. No.: 713,721

[22] Filed: Mar. 19, 1985

[30] Foreign Application Priority Data

Mar. 19, 1984 [JP] Japan ..... 59-52774

[51] Int. Cl.[4] ..... G03C 1/02

[52] U.S. Cl. ..... 430/560; 430/617; 430/619; 430/620; 430/562; 430/203; 430/592

[58] Field of Search ..... 430/617, 619, 620, 592, 430/560, 203, 562

[56] References Cited

° U.S. PATENT DOCUMENTS

| | | | |
|---|---|---|---|
| 2,186,624 | 1/1940 | Brooker | 430/592 |
| 3,385,707 | 5/1968 | Riester et al. | 430/592 |
| 3,933,507 | 1/1976 | Konig et al. | 430/592 |
| 4,259,424 | 3/1981 | Endo et al. | 430/619 |
| 4,500,626 | 2/1985 | Naito et al. | 430/203 |

*Primary Examiner*—Won H. Louie

*Attorney, Agent, or Firm*—Sughrue, Mion, Zinn, Macpeak, and Seas

[57] ABSTRACT

A heat developable light-sensitive material is described, comprising a dye represented by formula (I) or (II) as described in claim 1.

7 Claims, No Drawings

HEAT DEVELOPABLE LIGHT-SENSITIVE MATERIAL

FIELD OF THE INVENTION

This invention relates to a heat developable light-sensitive material, and more particularly to a heat developable light-sensitive material having improved preservability.

BACKGROUND OF THE INVENTION

Heretofore, photographic processes using silver halide have been most widely practiced for general photographic purposes, since they provide excellent sensitivity, gradation, and like photographic properties as compared, for example, with electrophotographic process and diazo-type photographic process. In recent years, techniques have been developed which provide images easily in a short time by employing, as a photographic development process for forming images on light-sensitive materials using silver halide, a dry processing involving heating in place of the conventional wet processing involving development in a developing solution.

Heat developable light-sensitive materials are known in the art, and heat developable light-sensitive materials and the process thereof are described, for example, in *Shashin-Kogyo no Kiso* (The Foundations of Photographic Technology), Corona Co., pp. 553 to 555 (1979); *Eizo Joho,* April 1978, p. 40; *Nebletts Handbook of Photography and Reprography,* 7th ed., Van Nostrand Reinhold Company, pp. 32 and 33, (1977); U.S. Pat. Nos. 3,152,904, 3,301,678, 3,392,020 and 3,457,075, British Pat. Nos. 1,131,108 and 1,167,777, and *Research Disclosure,* June 1978, pp. 9 to 15 (RD-17029).

Many processes have been proposed for obtaining color images. As to a process of forming color image by binding an oxidation product of a developing agent with a coupler, U.S. Pat. No. 3,531,286 has proposed p-phenylenediamine type reducing agents and phenolic or active methylene couplers, U.S. Pat. No. 3,761,270 has proposed p-aminophenol type reducing agents, Belgian Pat. No. 802,519 and *Research Disclosure,* September 1975, pp. 31 and 32 have proposed sulfonamidophenol type reducing agents, and U.S. Pat. No. 4,021,240 has proposed a combination of sulfonamidophenol type reducing agent and 4-equivalent coupler.

Also, processes for forming positive color images by a light-sensitive silver dye bleaching process, useful dyes and bleaching processes are described, for example, in *Research Disclosure,* April 1976, pp. 30 to 32 (RD-14433); ibid., December 1976, pp. 14 and 15 (RD-15227), and U.S. Pat. No. 4,235,957.

European Patent Application Nos. 76,492A and 79,056A, and Japanese Patent Application (OPI) Nos. 28928/83 and 26008/83 (the term "OPI" as used herein refers to a "Published unexamined Japanese patent application"), disclose an image-forming process by heat development utilizing a compound having a previously formed dye moiety and being capable of releasing a mobile dye at elevated temperatures corresponding to or inversely corresponding to reduction of silver halide to silver.

In these image-forming processes, alkali agents or alkali precursors are usually incorporated in light-sensitive materials for accelerating development upon heating. However, light-sensitive materials containing both a silver halide emulsion color-sensitized with a sensitizing dye and an alkali agent or an alkali precursor have a defect in that they tend to undergo a reduction in sensitivity during storage.

With the aforesaid system containing a compound having a previously formed dye moiety and being capable of releasing a mobile dye at elevated temperatures corresponding to or inversely corresponding to reduction of silver halide to silver, the use of a color-sensitized silver halide bring a particularly serious deterioration of preservability of light-sensitive materials. Since the dye-releasing compound itself has a dye moiety, the dye moiety may cause an interaction due to its dye properties with a sensitizing dye adsorbed on silver halide grains that have been color-sensitized with the sensitizing dye, such that the adsorbed sensitizing dye is desorbed from the surface of the silver halide grains during storage. This defect can be fatal with color light-sensitive materials and light-sensitive materials for electromagnetic waves of other regions than the intrinsic sensitivity region of silver halide.

SUMMARY OF THE INVENTION

The objects of the present invention are to overcome the above-described defects and to provide a heat developable light-sensitive material which is sufficiently stable to be stored for a long time a predetermined sensitivity.

The above-described and other objects of the present invention will become more apparent from the following description.

The objects of the present invention are attained by using a merocyanine type dye represented by formula (I) or (II), as described below. Thus, the present invention relates to a heat developable light-sensitive material comprising dye represented by formula (I) or (II).

DETAILED DESCRIPTION OF THE INVENTION

The compounds represented by formula (I) are those compounds which are represented by the following formula:

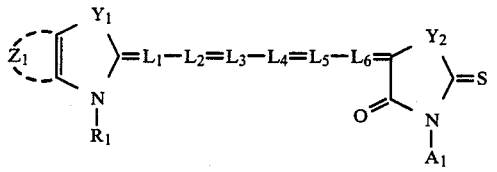

(I)

In formula (I), $R_1$ and $A_1$, which may be the same or different, each can represent an alkyl group (containing preferably from 1 to 8 carbon atoms, such as a methyl group, an ethyl group, a propyl group, a butyl group, a pentyl group, a heptyl group, etc.), or a substituted alkyl group (containing not more than 6 carbon atoms and being substituted, for example, by one or more of a carboxy group, a sulfo group, a cyano group, a halogen atom (e.g., a fluorine atom, a chlorine atom, a bromine atom, etc.), a hydroxyl group, an alkoxycarbonyl group (containing not more than 8 carbon atoms, e.g., a methoxycarbonyl group, an ethoxy carbonyl group, a benzoyloxycarbonyl group, etc.), an alkoxy group (containing not more than 7 carbon atoms, e.g., a methoxy group, an ethoxy group, a propoxy group, a butoxy group, a benzyloxy group, etc.), an aryloxy group (e.g., a phenoxy group, a p-tolyloxy group, etc.), an acyloxy group (containing not more than 3 carbon atoms, e.g., an acetyloxy group, a propionyloxy group, etc.), an acyl group (containing not more than 8 carbon atoms, e.g., an acetyl group, a propionyl group, a benzoyl group, a mesyl group, etc.), a carbamoyl group (e.g., a carbamoyl group, an N,N-dimethylcarbamoyl group, a morpholinocarbamoyl group, a piperidinocarbamoyl group, etc.), a sulfamoyl group (e.g., a sulfamoyl group, an N,N-dimethylsulfamoyl group, a morpholinosulfonyl group, etc.), an aryl group (e.g., a phenyl group, a p-hydroxyphenyl group, a p-carboxyphenyl group, a p-sulfophenyl group, an α-naphthyl group, etc.), etc.).

$A_1$ can also represents a phenyl group, a pyridyl group, a substituted phenyl group or a substituted pyridyl group, in addition to the above-described groups. Substituents for the substituted phenyl or substituted pyridyl group include, for example, a sulfo group, a carboxyl group, a cyano group, a halogen atom (e.g., chlorine atom, a fluorine atom, etc.), an alkyl group containing from 1 to 4 carbon atoms, an alkoxy group containing from 1 to 4 carbon atoms, a dialkylamino group, an acyl group, an alkoxycarbonyl group, etc.

$Y_1$ represents an oxygen atom, a sulfur atom, a selenium atom,

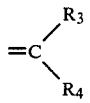

wherein $R_3$ and $R_4$ each represents a methyl group or an ethyl group), $=N-R_5$ (wherein $R_5$ represents an unsubstituted or substituted alkyl group containing not more than 5 carbon atoms (substituents including a hydroxyl group, a halogen atom, a carboxyl group, a sulfo group, an alkoxy group, etc.), or an allyl group) or —CH=CH—.

$Y_2$ represents an oxygen atom, a sulfur atom, $=N-A_2$ (wherein $A_2$ is the same as defined for $R_5$, or represents a phenyl group, a pyridyl group, a substituted phenyl group or a substituted pyridyl group substituted, for example, by a sulfo group, a carboxyl group, a cyano group, a halogen atom (e.g., a chlorine atom, a fluorine atom, etc.), an alkyl group containing from 1 to 4 carbon atoms, an alkoxy group containing from 1 to 4 carbon atoms, dialkylamino group, an acyl group, an alkoxycarbonyl group, etc.).

$Z_1$ represents atoms forming an unsubstituted or substituted benzene ring or naphthalene ring, substituted for example, by a lower alkyl group (e.g., a methyl group), a halogen atom, a phenyl group, a hydroxyl group, an alkoxy group containing from 1 to 4 carbon atoms, a carboxyl group, an alkoxycarbonyl group, an alkylsulfamoyl group, an alkylcarbamoyl group, an acyl group, a cyano group, a trifluoromethyl group, a nitro group, etc.

Nitrogen-containing hetero rings formed by $Y_1$ and $Z_1$ include, for example, a thiazole nucleus system (e.g., benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 5-methyl-6-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole, etc.), a selenazole nucleus system (e.g., benzoselenazole, 5-chlorobenzoselenazole, 5-methoxybenzoselenazole, 5-methylbenzoselenazole, 5-hydroxybenzoselenazole, naphtho[2,1-d]selenazole, naphtho[1,2-d]selenazole, etc.), an oxazole nucleus system (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluoromethylbenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole, 5-ethoxybenzoxazole, naphtho[2,1-d]oxazole, naphtho[1,2-d]oxazole, naphtho[2,3-d]oxazole, etc.), a quinoline nucleus (e.g., B 2-quinoline, 3-methyl-2-quinoline, 5-ethyl-2-quinoline, 6-methyl-2-quinoline, 8-fluoro-2-quinoline, 6-methoxy-2-quinoline, 6-hydroxy-2-quinoline, 8-chloro-2-quinoline, 8-fluoro-2-quinoline, etc.), a 3,3-dialkylindolenine nucleus system (e.g., 3,3-dimethylindolenine, 3,3-diethylindolenine, 3,3-dimethyl-5-cyanoindolenine, 3,3-dimethyl-5-methoxyindolenine, 3,3-dimethyl-5-methylindolenine, 3,3-dimethyl-5-chloroindolenine, etc.), an imidazole nucleus system (e.g., 1-methylbenzimidazole, 1-ethylbenzimidazole, 1-methyl-5-chlorobenzimidazole, 1-ethyl-5-chlorobenzimidazole, 1-methyl-5,6-dichlorobenzimidazole, 1-ethyl-5,6-dichlorobenzimidazole, 1-ethyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-phenyl-5,6-dichlorobenzimidazole, 1-allyl-5,6-dichlorobenzimidazole, 1-allyl-5-chlorobenzimidazole, 1-phenylbenzimidazole, 1-phenyl-5-chlorobenzimidazole, 1-methyl-5-trifluoromethylbenzimidazole, 1-ethyl-5-trifluoromethylbenzimidazole, 1-ethylnaphtho[1,2-d]imidazole, etc.), etc.

$L_1$ through $L_6$ each represents a methine group or a substituted methine group. Substituents for the methine group include an alkyl group (containing preferably from 1 to 5 carbon atoms, e.g., a methyl group, an ethyl group, a propyl group, etc.), a substituted alkyl group (substituted, for example, by a phenyl group or a hydroxyl group), an aryl group (e.g., a phenyl group), an alkoxy group, etc. Furthermore, $L_2$ and $L_4$ or $L_4$ and $L_6$ can be bonded to each other to form a 5- or 6-membered ring.

The compounds represented by formula (II) are those which are represented by the following formula:

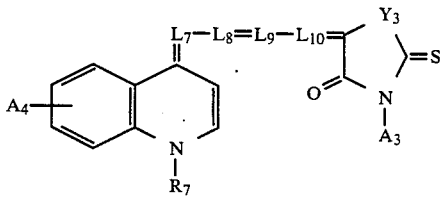

(II)

In formula (II), $Y_3$, $R_7$, and $A_3$ represent the same atoms or groups as defined for $Y_2$, $R_1$, and $A_1$, respectively.

$A_4$ represents an alkyl group containing from 1 to 4 carbon atoms (e.g., a methyl group), a halogen atom (e.g., a fluorine atom, a chlorine atom, etc.), a phenyl group, a hydroxyl group, an alkoxy group containing from 1 to 4 carbon atoms, a carboxyl group, an alkoxycarbonyl group, an alkylsulfamoyl group, an alkylcarbamoyl group, an acyl group, a cyano group, a trifluoromethyl group, a nitro group, etc.

$L_7$ through $L_{10}$ each represents a methine group or a substituted methine group. Examples of the substituent for the substituted methine group include an alkyl group (containing preferably from 1 to 5 carbon atoms, e.g., a methyl group, an ethyl group, a propyl group, etc.), a substituted alkyl group (substituted, for example, by a phenyl group, a hydroxyl group, etc.), an aryl group (e.g., a phenyl group), an alkoxy group, etc.

An addition amount of the dye represented by formula (I) or (II) is generally from $10^{-8}$ to $10^{-2}$ mol, preferably $10^{-7}$ to $10^{-4}$ mol, per mol of silver halide.

Specific examples of compounds of formulae (I) and (II) are illustrated below.

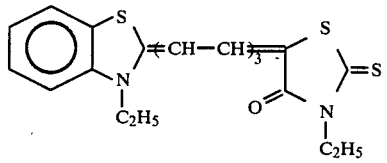

(I)-(1)

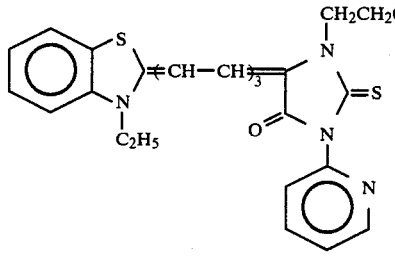

(I)-(2)

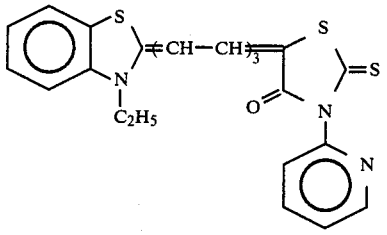

(I)-(3)

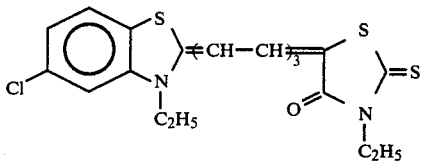

(I)-(4)

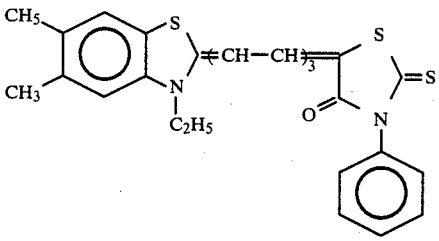

(I)-(5)

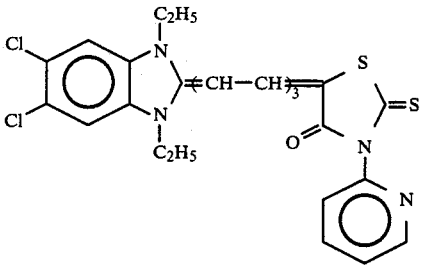

(I)-(6)

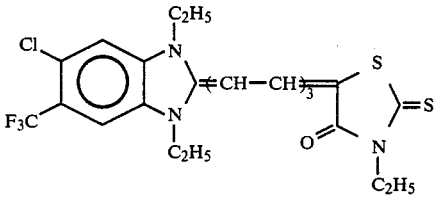

(I)-(7)

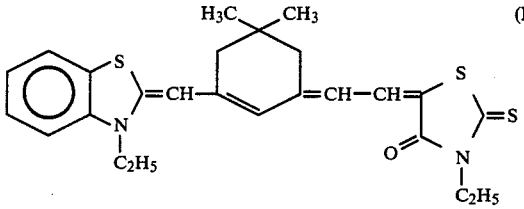

(I)-(8)

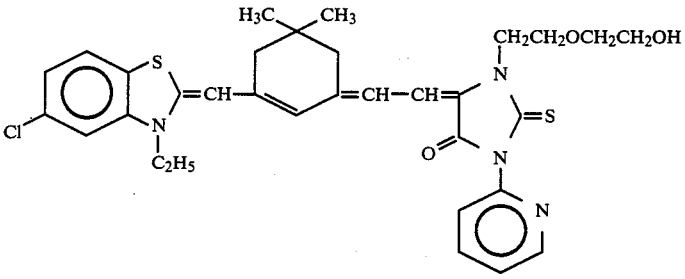

(I)-(9)

-continued
(I)-(10)
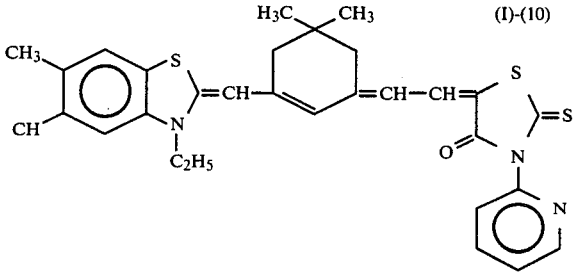
(I)-(11)
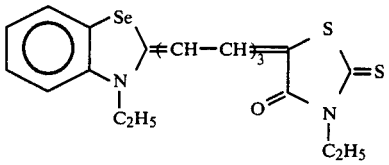
(I)-(12)
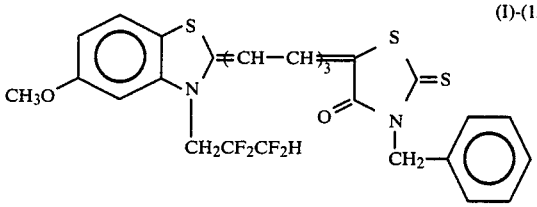
(I)-(13)
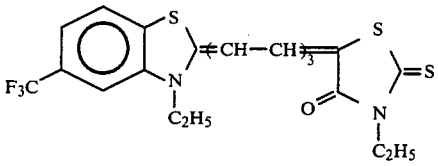
(I)-(14)
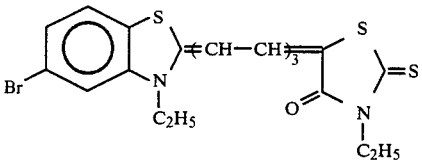
(I)-(15)
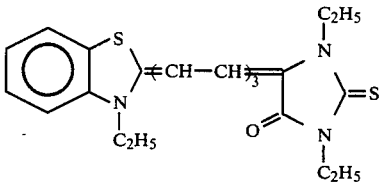
(I)-(16)
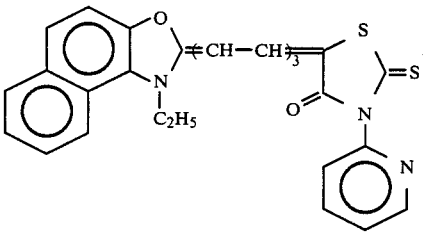
(I)-(17)
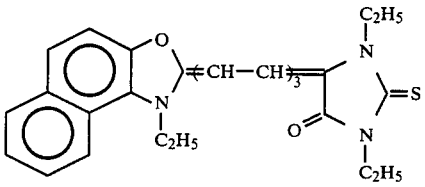
(I)-(18)
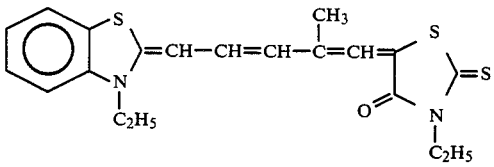
(I)-(19)
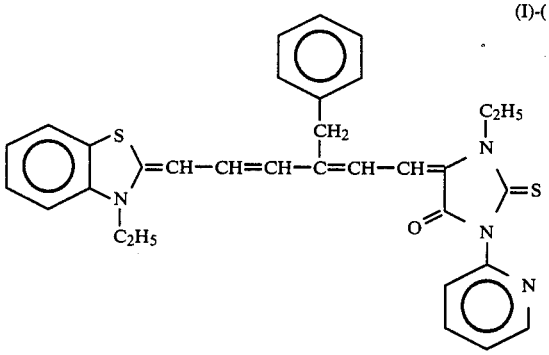
(I)-(20)
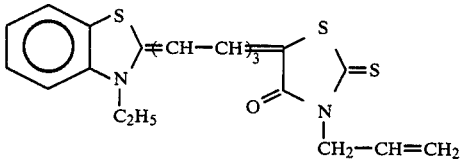
(II)-(1)
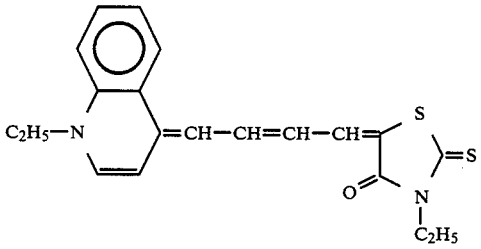

-continued (II)-(2)

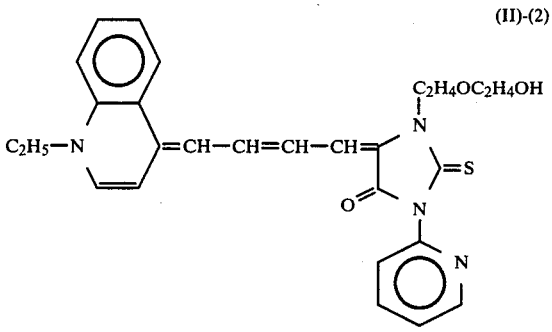

(II)-(3)

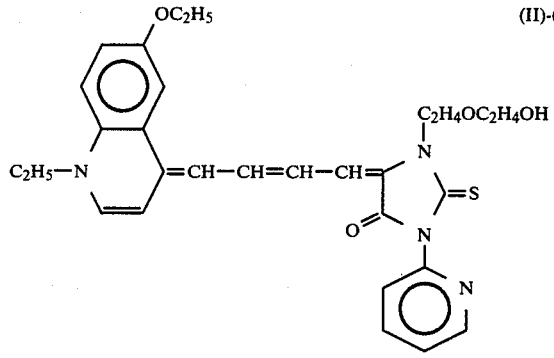

(II)-(4)

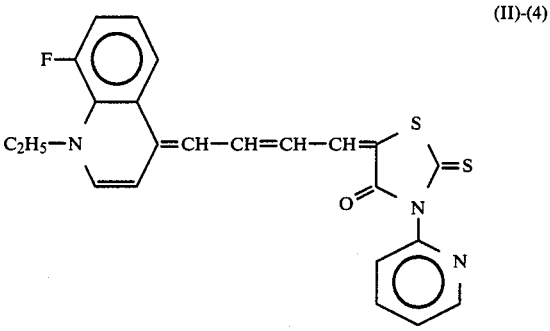

(II)-(5)

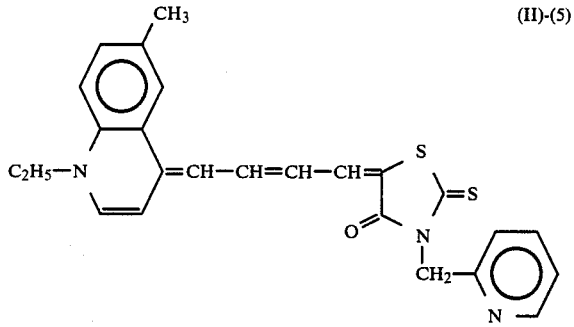

Synthesis of Compound (I)-(1)

6.6 g ($1.83\times10^{-2}$M) of 5-{5-(N-acetylanilino)-2,4-pentadienylidene}-3-ethylrhodanine, 6.4 g ($1.83\times10^{-2}$M) of 3-ethyl-2-methylbenzothiazolium-4-methylbenzenesulfonate, and 3.7 g ($3.66\times10^{-2}$M) of triethylamine were dispersed in 100 ml of methanol, and the resulting dispersion was refluxed for about 1.5 hours while stirring, then cooled with ice. Crystals thus precipitated were collected by filtration, then washed with 50 ml of methanol. The thus obtained crystals were dissolved in 50 ml of DMF and, after filtration, 500 ml of methanol was added to the filtrate. Crystals formed were collected by filtration, and washed with 200 ml of methanol to obtain 4.9 g of the end product (yield: 68.0%; m.p. 228°-231° C.).

Other dyes can be synthesized in the same general manner as compound (I)-(1). Apart from this process, a process for synthesizing, for example, compound (I)-(1) from 2-(6-N-acetylanilinohexa-1,3,5-triethyl)-3-ethylbenzothiazolium 4-methylbenzenesulfonate and 3-ethylrhodanine may be employed for obtaining the end product.

Melting points of a series of dyes are shown below:

| | m.p. |
|---|---|
| (I)-(2) | 110-113° C. |
| (I)-(3) | 250-261° C. |
| (I)-(4) | 250-252° C. |
| (I)-(8) | 150-154° C. |
| (I)-(14) | 258-260° C. |
| (I)-(15) | 95-100° C. |
| (I)-(18) | 190° C. |
| (I)-(20) | 208-210° C. |
| (II)-(1) | 185-190° C. |
| (II)-(2) | 152-153° C. |
| (II)-(3) | 132-135° C. |
| (II)-(4) | 189-192° C. |

All of the foregoing specific examples of the compounds of formulae (I) and (II) are sensitizing dyes for infrared light. Since conventional heat developable light-sensitive materials using compounds capable of releasing mobile dyes as a function of oxidation-reduction reaction suffer serious desensitization over time of infrared light-sensitive layers, thereof the heat developable light-sensitive material of the present invention is particularly preferable in an infrared-sensitive layer.

The alkali or alkali precursor to be used in the light-sensitive material of the present invention is not particularly limited. Preferable examples of the inorganic alkali include hydroxides, secondary or tertiary phosphates, borates, carbonates, quinolinates, and metaborates of alkali or alkaline earth metals; ammonium hydroxide; quaternary alkyl-ammonium hydroxides; hydroxides of other metals; etc., and preferable examples of the organic base include aliphatic amines (e.g., trialkylamines, hydroxylamines, aliphatic polyamines, etc.), aromatic amines (e.g., N-alkyl-substituted aromatic amines, N-hydroxylalkyl-substituted aromatic amines, and bis[p-(dialkylamino)phenyl)methanes], heterocyclic amines, amidines, cyclic amidines, guanidines, and cyclic guanidines. Further, U.S. Pat. No. 2,410,644 describes that betaine tetramethylammonium iodide and diaminobutane dihydrochloride are useful, and U.S. Pat. No. 3,506,444 describes urea and amino acids (e.g., 6-aminocaproic acid) as useful. In the present invention, those which have a pKa value of 8 or more are particularly useful.

As the alkali precursor, salts and compounds which undergo some reaction upon heating to release bases, such as salts between organic acids and bases which undergo decomposition upon heating to decompose, and compounds which are decomposed according to Lossen rearrangement, Beckmann rearrangement, or the like to release amine, are used.

Preferable examples of the alkali precursor include precursors of the aforementioned organic alkalis. Example include salts formed with heat-decomposable organic acids (e.g., trichloroacetic acids, trifluoroacetic acid, propiolic acid, cyanoacetic acid, sulfonylacetic acid, acetoacetic acid, etc.), and salts formed with 2-carboxycarboxamide described in U.S. Pat. No. 4,088,496.

Specific preferable examples of the alkali precursors are described below. As compounds which are considered to undergo decarboxylation of the acid moiety to release a base, there are compounds such as trichloroacetic acid derivatives (e.g., guanidinetrichloroacetic acid, piperidinetrichloroacetic acid, morpholinetrichloroacetic acid, p-toluidinetrichloroacetic acid, 2-picolinetrichloroacetic acid, etc.).

In addition, alkali precursors as described in British Pat. No. 998,945, U.S. Pat. No. 3,220,846, Japanese Patent Application (OPI) No. 22625/75, etc., can be used.

As examples other than the trichloroacetic acid derivatives, there are salts between bases and 2-carboxycarboxamide derivatives described in U.S. Pat. No. 4,088,496, α-sulfonylacetate derivatives described in U.S. Pat. No. 4,060,420, and propiolic acid derivatives described in Japanese Patent Application (OPI) No. 180537/84. As the base component, salts with alkali metals or alkaline earth metals are also useful, as well as salts with the organic bases, and examples thereof are described in European Patent Application No. 125521A.

As other precursors, hydroxamcarbamates described in European Patent Application No. 120661A utilizing Lossen rearrangement, aldoximecarbamates described in Japanese Patent Application (OPI) No. 157637/84 producing nitrile, etc. are effective.

Further, amineimides described in *Research Disclosure,* May 1977, (RD-15776) and aldoneamide described in Japanese Patent Application (OPI) No. 22625/75 are decomposed at elevated temperatures to produce base, thus being preferably usable.

These alkalis or alkali precursors may be used in a wide range of amounts, usefully in amounts of not more than 50 wt%, and more preferably 0.01 wt% to 40 wt%, based on the weight of the dried coating of the light-sensitive material.

The above-described alkalis or alkali precursors may, of course, be used for other purposes (for example, adjustment of pH value) as well as for acceleration of dye-releasing.

In addition to the sensitizing dye and the above-described alkali or alkali precursor, a dye providing substance can be added to a heat developable light-sensitive material. As the dye-providing substance, a compound having a dye moiety within the molecule which, when released from the molecule, forms a mobile dye and being capable of releasing the mobile dye corresponding to or inversely corresponding to the reduction of silver halide to silver at elevated temperatures (hereinafter merely referred to as dye-releasing compound, is used. Light-sensitive materials using conventional sensitizing dyes suffer accelerated desensitization with time due to the presence of the dye-releasing compound. However, when the compound of the foregoing formula (I) or (II) is used as a sensitizing dye, the desensitization over time can be greatly depressed in spite of the presence of the dye providing substance.

In the present invention, the light-sensitive material comprising using the dye represented by the formula (I) or (II) and the alkali or alkali precursor together, or using the dye represented by the formula (I) or (II) and the compound being capable of releasing a mobile dye corresponding to or inversely corresponding to the reduction of silver halide to silver at elevated temperatures (i.e., dye-releasing compound) together is preferred, and of them, the light-sensitive material comprising using the dye represented by the formula (I) or (II) and the alkali or alkali precursor together is more preferred in view of the fact that the effects of the present invention can be fully achieved. Further, when the dye represented by the formula (I) or (II) is used together with the dye-releasing compound, it is more preferred that the dye-releasing compound is the following dye-releasing compound represented by the formula (CI).

The dye-releasing compounds are preferably represented by the formula (CI).

$$(\text{Dye-X})_q\text{-Y} \qquad \text{(CI)}$$

In formula (CI), Dye represents a dye moiety which, when released from the molecule, has a diffusibility different from that of $(\text{Dye-X})_q$-Y and which preferably has a hydrophilic group. Usable dyes include azo dyes, azomethine dyes, anthraquinone dyes, naphthoquinone dyes, styryl dyes, nitro dyes, quinoline dyes, carbonyl dyes, phthalocyanine dyes, etc. Typical examples thereof are illustrated in groups. Additionally, these dyes may be used in a temporarily short-shifted form which can be restored to the original form upon development processing.

Specifically, dyes described in European Patent Application No. 76492A can be utilized.

q represents 1 or 2 and, when q=2, Dye-X may be the same or different from each other.

X represents a chemical bond or a linking group such as —NR— (wherein R represents a hydrogen atom, an alkyl group or a substituted alkyl group), —$SO_2$—, —CO—, and alkylene group, a substituted alkylene group, a phenylene group, a substituted phenylene group, a naphthylene group, a substituted naphthylene group, —O—, —SO— or a group formed by the combination of two or more of them.

Y represents a group which releases Dye corresponding to or inversely corresponding to light-sensitive silver salt having imagewise latent image to cause difference in diffusibility between the released dye and the compound represented by $(\text{Dye-X})_q$-Y.

Preferably, the compound represented by $(\text{Dye-X})_q$-Y itself is diffusion-resistant and releases mobile Y.

In the present invention, the compound represented by $(\text{Dye-X})_q$-Y is used in an amount of from 0.01 to 4 mol, preferably from 0.03 to 1 mol, per mol of silver halide.

Y is described in detail below.

Y is to be selected so that the compound represented by the formula of (CI) becomes a dye-releasing, non-diffusible compound which is oxidized, as a result of development processing, to undergo self-cleavage and provide a diffusible dye.

Examples of Y effective for this type compounds are N-substituted sulfamoyl groups. For example, those groups which are represented by the following formula (CII) illustrate examples of Y

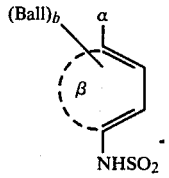

(CII)

wherein $\beta$ represents non-metallic atoms forming a benzene ring, which may optionally be condensed with a carbon ring of a hetero ring to form, for example, a naphthalene ring, a quinoline ring, a 5,6,7,8-tetrahydronaphthalene ring, a chroman ring, or the like;

$\alpha$ represents a group of $-OG^{11}$ or $-NHG^{12}$ (wherein $G^{11}$ represents a hydrogen atom or a group which forms a hydroxy group upon being hydrolyzed, and $G^{12}$ represents a hydrogen atom, an alkyl group containing from 1 to 22 carbon atoms or a hydrolyzable group); and Ball represents a ballast group.

Specific examples of this type of Y are described, e.g., in Japanese Patent Application (OPI) Nos. 33826/73 and 50736/78.

Another examples of Y suited for these types compounds are those represented by formula (CIII)

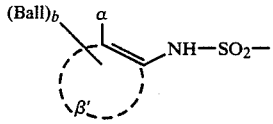

(CIII)

wherein Ball, $\alpha$, and b are the same atoms or groups as defined for formula (CII), $\beta'$ represents atoms forming a carbon ring, e.g., a benzene ring which may be condensed with another carbon ring or a hetero ring to form a naphthalene ring, quinoline ring, 5,6,7,8-tetrahydronaphthalene ring, chromane ring or the like. Specific examples of Y of this type are described in Japanese Patent Application (OPI) Nos. 113624/76, 12642/81, 16130/81, 16131/81, 4043/82, and 650/82, and U.S. Pat. No. 4,053,312.

Further examples of Y suited for these types of compounds are those represented by formula (CIV)

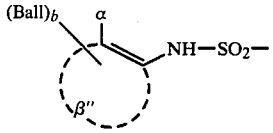

(CIV)

wherein Ball, $\alpha$, and b are the same atoms or groups as defined for formula (CII), and $\beta''$ represents atoms forming a hetero ring such as a pyrazole ring, a pyridine ring or the like, said hetero ring being optionally bound to a carbon ring or another hetero ring. Specific examples of Y of this type are described in Japanese Patent Application (OPI) No. 104343/76.

Still further examples of Y suited for these types of compounds are those represented by formula (CV)

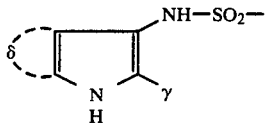

(CV)

wherein $\gamma$ preferably represents a hydrogen atom, a substituted or unsubstituted alkyl, aryl or hetero ring group, or $-CO-G^{21}$, $G^{21}$ represents $-OG^{22}$, $-SG^{22}$ or

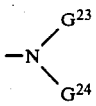

(wherein $G^{22}$ represents a hydrogen atom, an alkyl group, a cycloalkyl group or an aryl group, $G^{23}$ is the same atoms or groups as defined for said $G^{22}$, or $G^{23}$ represents an acyl group derived from an aliphatic or aromatic carboxylic or sulfonic acid, and $G^{24}$ represents a hydrogen atom or an unsubstituted or substituted alkyl group), and $\delta$ represents a residue necessary for completing a condensed benzene ring.

Specific examples of Y of this type are described in Japanese Patent Application (OPI) Nos. 104343/76, 46730/78, 130122/79, and 85055/82.

Still further examples of Y suited for these types of compounds are those represented by formula (CVI)

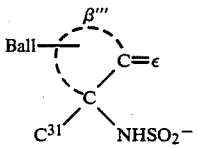

(CVI)

wherein Ball is the same as defined for formula (CII), $\epsilon$ represents an oxygen atom or $=NG^{32}$ (wherein $G^{32}$ represents a hydroxy group or an optionally substituted amino group) (examples of $H_2N-G^{32}$ to be used for forming the group of $=NG^{32}$ including hydroxylamine, hydrazines, semicarbazides, thiosemicarbazides, etc.), $\beta'''$ represents a saturated or unsaturated, nonaromatic, 5-, 6- or 7-membered hydrocarbon ring, and $G^{31}$ represents a hydrogen atom or a halogen atom (e.g., a fluorine atom, a chlorine atom, a bromine atom, etc.).

Specific examples of Y of this type are described in Japanese Patent Application of (OPI) Nos. 3819/78 and 48534/79.

Other examples of Y of these types, of compounds are described in Japanese Patent Publication Nos. 32129/73, 39165/73, Japanese Patent Application (OPI) No. 64436/74, U.S. Pat. No. 3,443,934, etc.

Still further examples of Y are those represented by formula (CVII)

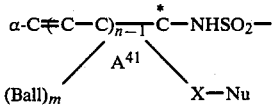

(CVII)

wherein $\alpha$ represents $OR^{41}$ or $NHR^{42}$, $R^{41}$ represents a hydrogen atom or a hydrolyzable component, $R^{42}$ represents a hydrogen atom or an alkyl group containing from 1 to 50 carbon atoms, $A^{41}$ represents atoms forming an aromatic ring, Ball represents an organic immobile group existing on the aromatic ring, with the Ball groups being the same or different from each other, m represents an integer of 1 or 2, X represents a divalent organic group having from 1 to 8 atoms, with the nucleophilic group (Nu) and an electrophilic center (asterisked carbon atom) formed by oxidation forming a 5- to 12-membered ring, Nu represents a nucleophilic group, n represents an integer of 1 or 2, and $\alpha$ may be the same as defined for formula (CII). Specific examples of Y of this type are described in Japanese Patent Application (OPI) No. 20735/82.

As still further types of examples of the compounds represented by the formula (CI), there are dye-releasing, non-diffusible compounds which release a diffusible dye in the presence of a base as a result of self-cyclization, but which, when reacted with an oxidation product of a developing agent, substantially never release the dye.

Examples of Y effective for this type compounds are those which are represented by formula (CVIII)

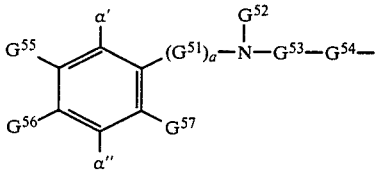

(CVIII)

wherein $\alpha'$ represents an oxidizable nucleophilic group (e.g., a hydroxyl group, a primary or secondary amino group, a hydroxyamino group, a sulfonamido group or the like) or a precursor thereof;

$\alpha''$ represents a dialkylamino group or an optional group defined for $\alpha'$;

$G^{51}$ represents an alkylene group having 1 to 3 carbon atoms;

a represents 0 or 1;

$G^{52}$ represents a substituted or unsubstituted alkyl group having 1 to 40 carbon atoms or a substituted or unsubstituted aryl group having 6 to 40 carbon atoms;

$G^{53}$ represents an electrophilic group such as —CO— or —CS—;

$G^{54}$ represents an oxygen atom, a sulfur atom, a selenium atom, a nitrogen atom or the like, and, when $G^{54}$ represents a nitrogen atom, it may be substituted by a hydrogen atom, an alkyl or substituted alkyl group having from 1 to 10 carbon atoms, or an aromatic residue having from 6 to 20 carbon atoms.

$G^{55}$, $G^{56}$ and $G^{57}$ each represents a hydrogen atom, a halogen atom, a carbonyl group, a sulfamoyl group, a sulfonamido group, an alkyloxy group having 1 to 40 carbon atoms or an optional group defined for $G^{52}$, $G^{55}$ and $G^{56}$ may form a 5- to 7-membered ring, and $G^{56}$ may represent

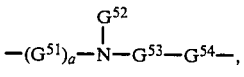

with the proviso that at least one of $G^{52}$, $G^{55}$, $G^{56}$ and $G^{57}$ represents a ballast group. Specific examples of this type of Y are described in Japanese Patent Application (OPI) No. 63618/76.

Further examples of Y suited for these types of compounds are those which are represented by formulae (CIX) and (CX)

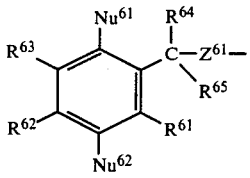

(CIX)

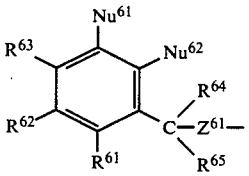

(CX)

wherein $Nu^{61}$ and $Nu^{62}$, which may be the same or different, each represents a nucleophilic group or a precursor thereof; $Z^{61}$ represents a divalent atom group which is electrically negative with respect to the carbon atom substituted by $R^{64}$ and $R^{65}$; $R^{61}$, $R^{62}$, and $R^{63}$ each represents a hydrogen atom, a halogen atom, an alkyl group, an alkoxy group or an acylamino group, or, when located at adjacent positions on the ring, $R^{61}$ and $R^{62}$ together can form a condensed ring with the rest of the molecule, or $R^{62}$ and $R^{63}$ together can form a condensed ring with the rest of the molecule; $R^{64}$ and $R^{65}$, which may be the same or different, each represents a hydrogen atom, a hydrocarbon group or a substituted hydrocarbon group; with at least one of the substituents, $R^{61}$, $R^{62}$, $R^{63}$, $R^{64}$ and $R^{65}$, having a ballast group, Ball, of a sufficient size so as to render the above-described compounds immobile. Specific examples of Y this type are described in Japanese Patent Application (OPI) Nos. 69033/78 and 130927/79.

Further examples of Y suited for these types of compounds are those which are represented by formula (CXI)

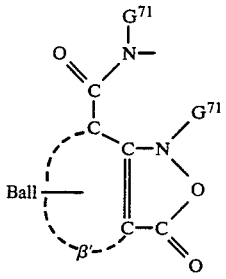

(CXI)

wherein Ball and $\beta'$ are the same as defined for those in formula (CIII), and $G^{71}$ represents an alkyl group (including a substituted alkyl group). Specific examples of Y of this type are described in Japanese Patent Application (OPI) Nos. 111628/74 and 4819/77.

As different types of compounds represented by the formula (CI), there are also dye-releasing, non-diffusible compounds which themselves do not release any dye, but which, when react upon a reducing agent, release a dye. With these compounds, compounds which mediate the redox reaction (so-called electron donors) are preferably used in combination.

Examples of Y effective for these types of compounds are those represented by formula (CXII):

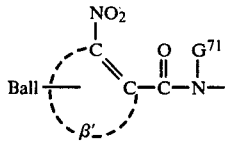

(CXII)

wherein Ball and $\beta'$ are the same as defined for these in formula (CIII), and $G^{71}$ represents an alkyl group (including a substituted alkyl group). Specific examples of Y of this type are described in Japanese Patent Application (OPI) Nos. 35533/78 and 110827/78.

Further examples of Y suited for these types of compounds are those which are represented by formula (CXIII)

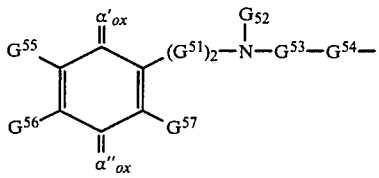

(CXIII)

wherein $\alpha'_{ox}$ and $\alpha''_{ox}$ represent groups capable of providing $\alpha'$ and $\alpha''$, respectively, upon reduction, and $\alpha'$, $\alpha''$, $G^{51}$, $G^{52}$, $G^{53}$, $G^{54}$, $G^{55}$, $G^{56}$, $G^{57}$, and a are the same as defined for those in formula (CVIII). Specific examples of Y described above are described in Japanese Patent Application (OPI) No. 110827/78, U.S. Pat. Nos. 4,356,249 and 4,358,525.

Further examples of Y suited for this type of compounds are those which are represented by formulae (CXIVA) and (CXIVB)

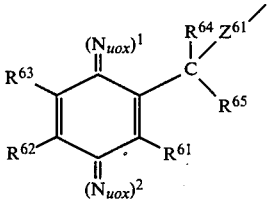

(CXIVA)

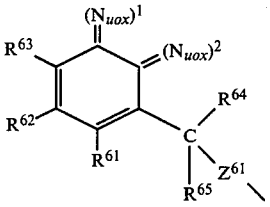

(CXIVB)

wherein $(N_{uox})^1$ and $(N_{uox})^2$, which may be the same or different, each represents an oxidized nucleophilic group, and other notations are the same as defined for those in formulae (CIX) and (CX). Specific examples of Y of this type are described in Japanese Patent Application (OPI) Nos. 130927/79 and 164342/81.

The published documents having been referred to above with respect to CXII, CXIII, CXIVA, and CXIVB also describe electron donors to be used in combination therewith.

As still further different type compounds represented by the formula (CI), there are illustrated LDA compounds (Linked Donor Acceptor compounds). These compounds are dye-releasing, non-diffusible compounds which cause donor-acceptor reaction in the presence of a base to release a diffusible dye, but which, when react upon an oxidation product of a developing agent, they substantially stop releasing the dye.

Examples of Y effective for these types of compounds are those represented by formula (CXV) (specific examples thereof being described in British Pat. No. 2,140,927)

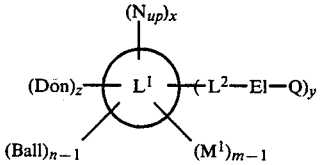

(CXV)

wherein n, x, y, and z each represents 1 or 2, m represents an integer of 1 or more; $D_{on}$ represents a group containing an electron donor or its precursor moiety; $L^1$ represents an organic group linking Nup to —El—Q or $D_{on}$; $N_{up}$ represents a precursor of a nucleophilic group; El represents an electrophilic center; Q represents a divalent group; Ball represents a ballast group; $L^2$ represents a linking group; and $M^1$ represents an optional substituent.

The ballast group is an organic ballast group which can render the dye-releasing, non-diffusible compound and is preferably a group containing hydrophobic group having from 8 to 32 carbon atoms. Such organic ballast group is bound to the dye-releasing compound directly or through a linking group (e.g., an imino bond, an ether bond, a thioether bond, a carbonamido bond, a sulfonamido bond, an ureido bond, an ester bond, an imido bond, a carbamoyl bond, a sulfamoyl bond, etc., and combination thereof).

However, the dye providing substance to be used for the light-sensitive material of the present invention is not limited only to these dye-releasing compounds but, for example, couplers may be used as well.

As to the couplers, U.S. Pat. No. 3,531,286 describes p-phenylenediamine reducing agents and phenolic or active methylene couplers, U.S. Pat. No. 3,761,270 describes p-aminophenol type reducing agents, Belgian Pat. No. 802,519 and *Research Disclosure*, September 1975, pp. 31 and 32 describe sulfonamidophenol type reducing agents, and U.S. Pat. No. 4,021,240 proposes a combination of a sulfonamidophenol type reducing agent and 4-equivalent coupler.

In addition, conventionally well known color couplers used for liquid development processing may be used.

These couplers are compounds capable of coloring by oxidation coupling with, for example, an aromatic amine developing agent (e.g., a phenylenediamine derivative, an aminophenol derivative, etc.). Typical examples thereof are represented as follows. Magenta couplers include 5-pyrazolone couplers, pyrazolobenzimidazole couplers, cyanoacetylcoumarone couplers, open-chain acylacetonitrile couplers, etc., yellow couplers include acylacetamide couplers (e.g., benzoylacetanilides, pivaloylacetanilides, etc.), and cyan couplers include naphthol couplers and phenol couplers. In these couplers, non-diffusible couplers having a hydrophobic ballast group or polymerized couplers are desirable. The couplers may be either of 4-equivalent type and 2-equivalent type based on silver ion. Colored couplers having color-correcting effect or couplers capable of releasing a development restrainer upon development (so-called DIR couplers) may also be incorporated.

A process of introducing a nitrogen-containing hetero ring group into a dye to form a silver salt, and releasing the dye by heat development, described in *Research Disclosure,* May 1978, pp. 54 to 58 (RD-16966), can also be applied to the light-sensitive material of the present invention.

A process of forming a positive color image according to light-sensitive silver-dye bleaching process is described, for example, in *Research Disclosure,* April 1976, pp. 30 to 32 (RD-14433); ibid., December 1976 pp. 14 and 15 (RD-15227) and U.S. Pat. No. 4,235,957, and dyes useful for this process can also be utilized for the light-sensitive material of the present invention. In addition, a process of forming a color image utilizing leuco dyes is described, for example, in U.S. Pat. Nos. 3,985,565 and 4,022,617, and the leuco dyes described therein can also be utilized for the light-sensitive material of the present invention.

In the present invention, the dye providing substance can be introduced into light-sensitive materials according to known methods described, for example, in U.S. Pat. No. 2,322,027. In such cases, organic solvents having a high-boiling point and organic solvents having a low-boiling point as described above may be used.

For example, the dye-providing substance is dissolved in an organic solvent having a high-boiling point such as alkyl phthalate (e.g., dibutyl phthalate, dioctyl phthalate, etc.), a phosphate (diphenyl phosphate, triphenyl phosphate, tricresyl phosphate, dioctylbutyl phosphate, etc.), a citric ester (e.g., tributyl acetylcitrate), a benzoic ester (e.g., octyl benzoate), an alkylamide (e.g., diethyllaurylamide), a fatty acid ester (e.g., dibutoxyethyl succinate, dioctyl azelate, etc.), a trimesic ester (e.g., tributyl trimesate), etc. or an organic solvent having a boiling point of from about 30° C. to about 160° C. such as a lower alkyl acetate (e.g., ethyl acetate, butyl acetate, etc.), ethyl propionate, sec-butyl alcohol, methyl isobutyl ketone, $\beta$-ethoxyethyl acetate, methylcellosolve acetate, cyclohexanone or the like, then the resulting solution is dispersed in a hydrophilic colloid. The above-described, organic solvents having a high-boiling point may be used in combination with the organic solvents having a low-boiling point.

A method of dispersing the substance using a polymer described in Japanese Patent Publication No. 39853/76 and Japanese Patent Application (OPI) No. 59943/76 may also be employed. In dispersing the dye providing substance in a hydrophilic colloid, various surfactants may be used. As such surfactants, those given to as surfactants in other part of this specification may be used.

In the present invention, the organic solvent having a high-boiling point is used in an amount of not more than 10 g, preferably not more than 5 g, per g of the dye providing substance used.

In addition to the above-described compounds represented by formula (I) or (II), alkalis or alkali precursors, and dye providing substances such as dye-releasing compounds or couplers, the heat developable light-sensitive material of the present invention contains light-sensitive silver halide sensitized with the compound (I) or (II), an organic silver salt oxidizing agent, and a hydrophilic binder and, if necessary, a reducing agent, an image stabilizer, a thermal solvent, an image-toning agent, a hardening agent, etc.

Examples of the light-sensitive silver halide include silver chloride, silver chlorobromide, silver chloroiodide, silver bromide, silver iodobromide, silver chloroiodobromide, silver iodide, etc.

These silver halides may be obtained as follows. With silver bromide, for example, a silver nitrate solution is added to a potassium bromide solution to form silver bromide grains, followed by adding thereto potassium iodide.

As the silver halide, two or more silver halides different from each other in size and/or halide composition may be used in combination.

Silver halide grains to be used in the present invention preferably have an average grain size (diameter) of 0.001 $\mu$m to 10 $\mu$m, more preferably 0.001 $\mu$m to 5 $\mu$m.

The silver halide to be used in the present invention may be used as such, or may be chemically sensitized by using chemical sensitizers such as compounds of sulfur, selenium or tellurium, compounds of gold, platinum, palladium, rhodium or iridium, reducing agents such as tin halide, or a combination thereof. Detailed descriptions thereon are given in T. H. James, *The Theory of the Photographic Process,* 4th ed., Chap. 5, pp. 149–169.

A suitable coating amount of the light-sensitive silver halide in the present invention is from 1 mg to 10 g/m$^2$ calculated as an amount of silver.

Organic silver salt oxidizing agents are compounds capable of forming a silver image as a function of reaction with the above-described dye providing substance or a reducing agent which is, if necessary, allowed to copresent with the dye providing substance, when heated to 80° C. or above, preferably 100° C. or above, in the presence of light-sensitive silver halide.

Examples of such organic silver salt oxidizing agent are described in Japanese Patent Application (OPI) No. 58543/83, and include, for example, those described below.

Firstly, silver salts of organic compounds having a carboxy group can be used. Typical examples thereof include silver salts of aliphatic and aromatic carboxylic acids.

Other examples include silver salts of compounds having a mercapto group or a thione group and the derivatives thereof.

In addition, there are silver salts of compounds containing an imino group, such as silver salts of benzotriazole and derivatives thereof described in Japanese Patent Publication Nos. 30270/69 and 18416/70, silver salts of benzotriazole, silver salts of alkyl-substituted benzotriazoles (e.g., silver salt of methylbenzotriazole, etc.), silver salts of halogen-substituted benzotriazoles (e.g., silver salt of 5-chlorobenzotriazole), silver salts of carboimidobenzotriazoles (e.g., silver salt of butylcarboimidobenzotriazole), silver salts of 1,2,4-triazole and 1-H-tetrazole described in U.S. Pat. No. 4,220,709, silver salt of carbazole, silver salt of saccharin, silver salt of imidazole or imidazole derivative, etc.

Silver salts described in *Research Disclosure,* Vol. 170, June 1978, (RD-17029) and organometallic salts such as copper stearate are also usable in the present invention as the organo-metallic salt oxidizing agents.

Processes for preparing these silver halides and organic silver salts and methods for mixing them are described in Research Disclosure, Vol. 170, June 1978, (RD-17029); Japanese Patent Application (OPI) Nos.

32928/75, 42529/76, 13224/74, and 17216/75; and U.S. Pat. No. 3,700,458.

A suitable coating amount of the light-sensitive silver halide and the organic silver salt is from 50 mg to 10 g/m$^2$ calculated as an amount of silver.

The above-described light-sensitive silver halide and organic silver salt oxidizing agent are prepared in the following binder, and the dye providing substance is dispersed in the following binder.

Binders to be used in the present invention may be used alone or in combination. Hydrophilic binders may be used. Typical examples of the hydrophilic binder are transparent or semitransparent hydrophilic binders and include natural substances such as proteins (e.g., gelatin, gelatin derivatives and cellulose derivatives) and polysaccharides (e.g., starch, gum arabic, etc.) and synthetic polymer substances such as water-soluble polyvinyl compounds (e.g., polyvinylpyrrolidone, acrylamide polymer, etc.). Other synthetic polymer substances include dispersed vinyl compounds in a latex form, which serve to increase dimensional stability of the photographic materials.

Examples of reducing agents to be used in the present invention include the following: hydroquinone compounds (e.g., hydroquinone, 2,5-dichlorohydroquinone, 2-chlorohydroquinone, etc.), aminophenol compounds (e.g., 4-aminophenol, N-methylaminophenol, 3-methyl-4-aminophenol, 3,5-dibromoaminophenol, etc.), catechol compounds (e.g., catechol, 4-cyclohexylcatechol, 3-methoxycatechol, 4-(N-octadecylamino)catechol, etc.), phenylenediamine compounds (e.g., N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.), etc.

More preferable examples of the reducing agents are 3-pyrazolidone compounds (e.g., 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis-(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, 5-methyl-3-pyrazolidone, etc.).

Combinations of various developing agents as described in U.S. Pat. No. 3,039,869 may be used as well.

In the present invention, the reducing agent is generally added in an amount of from 0.01 to 20 mols, and particularly preferably from 0.1 to 10 mols, per mol of silver.

Supports to be used in the light-sensitive material of the present invention must withstand the processing temperatures used. As general supports, acetylcellulose film, cellulose ester film, polyvinyl acetal film, polystyrene film, polycarbonate film, polyethylene terephthalate film, and related films or resin materials are used as well as glass, paper, metal, and analogs thereof. Paper supports laminated with a polymer such as polyethylene may also be used. Polyesters described in U.S. Pat. Nos. 3,634,089 and 3,725,070 are preferably used.

The light-sensitive material in accordance with the present invention may contain, if desired, various additives known to be used for heat developable light-sensitive materials and other layers than the light-sensitive layer such as an antistatic layer, a conductive layer, a protective layer, an interlayer, an anti-halation layer, a strippable layer, etc. The various additives include those which are described in *Research Disclosure.* Vol. 170, June 1978, (RD-17029), such as plasticizers, dyes for improving sharpness, anti-halation dyes, matting agents, surfactants, brightening agents, fading-preventing agents, etc.

The protective layer, interlayer, subbing layer, backing layer, and other layers may be formed by preparing respective coating solutions, coating them on a support according to various coating methods such as a dip-coating method, an air knife-coating method, a curtain coating method, a hopper-coating method described in U.S. Pat. No. 3,681,294, etc., then drying the coated layers to prepare a light-sensitive material.

If desired, two or more layers may be coated simultaneously according to the method described in U.S. Pat. No. 2,761,791 and British Pat. No. 837,095.

In the present invention, various exposing means may be employed. Latent images may be obtained by image-wise exposure with radiation including visible light. In general, those usually used as light source, such as sun light, strobo flash, tungsten lamp, mercury-arc lamp, halogen lamp (e.g., iodide lamp), xenon lamp, laser light, CRT light source, plasma light source, fluorescent tube, light-emitting diode, etc. may be used.

As the original, photographic images with gradation may be used as well as line images of, for example, drawing. It is possible to take a photograph of a figure or a scene using a camera. Printing or an original may be effected by contact printing superposing the original on the light-sensitive material, by reflection printing, or by enlarge-printing.

In addition, images recorded by means of a video camera or image information transmitted from a television broadcasting station may be printed by directly displaying them on a cathode ray tube (CRT) or a fiber optical tube (FOT) and focusing the image on the heat developable light-sensitive material in a contact manner or using a lens system.

Light-emitting diode (LED) having recently been improved is being used as an exposing or displaying means in various devices. With LED, it is difficult to obtain LED effectively emitting blue light. Thus, in reproducing color images, three types of LED's emitting green light, red light, and infrared light, respectively, are used as exposing light sources, and light-sensitive portions sensitizing to these lights are designed to release yellow, magenta, and cyan dyes, respectively.

That is, it suffices to incorporate a yellow dye providing substance in a green-sensitive portion (layer), a magenta dye providing substance in a red-sensitive portion (layer), and a cyan dye providing substance in an infrared-sensitive portion (layer). Other combinations may be employed if desired.

In addition to the above-described process of directly contacting or projecting the original on the light-sensitive material, there are processes of reading the original irradiated with a light source by a light-receiving element such as a phototube or a charge coupling device (CCD), recording the image information on a memory of a computer or the like and, if necessary after image processing, reproducing the image information on CRT to utilize it as an imagewise light source, or directly allowing the three kinds of LED's according to the processed information to expose the light-sensitive material therewith.

Latent images obtained by exposing the heat developable color photographic element can be developed, for example, by heating the whole element for from about 0.5 to about 300 seconds at suitably elevated temperatures of from about 80° C. to about 250° C. Either of the higher temperatures and the lower temperatures within the above-described range may be employed by prolonging or shortening the heating time as long as the temperature is within the above-described range. Preferably, the temperature range from about 110° C. to about 160° C. Heating means may be by hot plate, iron, hot roller, heating element utilizing carbon or titanium white, or analogs thereof.

In the present invention, a specific process for forming a color image by heat development is a heat diffusion transfer of hydrophilic diffusible dye. A heat developable light-sensitive material adapted for this process is constituted by light-sensitive layer (I) containing at least silver halide, an organic silver salt oxidizing agent, a dye providing substance which also functions as a reducing agent for the oxidizing agent, a hydrophilic binder, and alkali or an alkali precursor and image receiving layer (II) capable of receiving the hydrophilic diffusible dye formed in layer (I), provided on a support or supports.

The above-described light-sensitive layer (I) and the image receiving layer (II) may be formed on one and the same supports or on different supports. The image-receiving layer (II) can be stripped off the light-sensitive layer (I). For example, after imagewise exposing the heat developable light-sensitive material and developing it by uniform heating, the image-receiving layer (II) may be peeled off.

In another specific process, image-receiving layer (II) may be superposed on imagewise exposed and uniformly heated light-sensitive layer (I), followed by transferring the formed dye at temperatures lower than the developing temperature. the phrase "temperatures lower than the developing temperature" include room temperature, and preferably means room temperature to a temperature lower than the developing temperature by 40° C. For example, when the heat developing temperature is 120° C., the transferring temperature is to be 80° C. as a general guide.

A further process is to imagewise expose only light-sensitive layer (I) and then uniformly heating it with image-receiving layer (II) superposed thereon.

The image-receiving layer (II) contains a dye mordant. Various mordants may be used in the present invention. Useful mordants may be selected depending upon physical properties of used dye, transferring conditions, other components contained in the photographic material, etc.

The mordant to be used in the present invention is generally a polymeric mordant.

The polymeric mordant to be used in the present invention includes polymers containing secondary and tertiary amino groups, polymers having nitrogen-containing hetero ring moiety, polymers having quaternary cation groups thereof, etc., which possess a molecular weight of from 5,000 to 200,000, and particularly 10,000 to 50,000, and is illustrated, for example, in Japanese Patent Application (OPI) No. 58,543/83, pp. 263 and 264.

The heat developable light-sensitive material of the present invention has great merit in that it undergoes little desensitization with time. Conventional heat developable light-sensitive materials suffer serious desensitization with time, particularly the infrared-sensitive layer, which has been a serious problem for putting heat developable color light-sensitive materials into practice. The heat developable light-sensitive material of the present invention is also effective as the infrared-sensitive layer due to its stability with time, thus making a great contribution to realization of heat developable color light-sensitive materials.

The present invention is now illustrated in greater detail by reference to the following examples which, however, are not to be construed as limiting the present invention in any way. Unless otherwise indicated, all parts, percents and ratios are by weight.

EXAMPLE 1

A silver chlorobromide emulsion was prepared as follows.

24 g of gelatin, 5.6 g of sodium chloride, and 0.6 g of potassium bromide were dissolved in 1 liter of water (solution I). This solution was stirred with keeping the temperature at 50° C. Then, a solution of 100 g of silver nitrate in 300 cc of water (solution a) and a solution of 40 g of sodium chloride and 20 g of potassium bromide in 300 cc of water (solution b) were simultaneously added thereto for 90 minutes.

pH of the resulting silver chlorobromide emulsion was adjusted to render the emulsion precipitate, and after removal of excess salts, 70 g of water and 12 g of gelatin were added thereto to adjust the pH of the emulsion to 6.0. After gold sensitization and sulfur sensitization, there was obtained 400 g of a silver chlorobromide emulsion.

A benzotriazole silver salt emulsion was prepared as follows.

28 g of gelatin and 13.2 g of benzotriazole were dissolved in 3000 ml of water. This solution was stirred with keeping the temperature at 40° C. Then, a solution of 17 g of silver nitrate in 100 ml of water was added to this solution for 2 minutes.

pH of the resulting benzotriazole silver salt emulsion was adjusted to render the emulsion precipitate, and after removal of excess salts. Then, the pH of the emulsion was adjusted to 6.0 to obtain 400 g of a benzotriazole silver salt emulsion.

A dispersion of a dye providing substance in gelatin was prepared as follows.

(1)

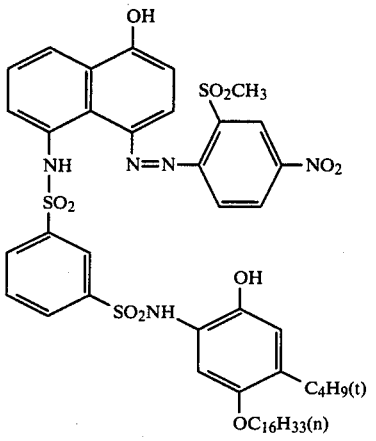

5 g of cyan dye providing substance (1) described above, 0.5 g of sodium 2-ethyl-hexyl sulfosuccinate, and 5 g of tricresyl phosphate (TCP) were weighed, and 30 ml of ethyl acetate was added thereto. The resulting mixture was heated at about 60° C. to obtain a uniform solution. This solution was mixed with 100 g of a 10% solution of lime-processed gelatin under stirring, followed by dispersing for 10 minutes in a homogenizer at 10,000 rpm.

This dispersion is referred to as a dispersion of dye providing substance (1).

A light-sensitive material was prepared as follows.

| | | |
|---|---|---|
| (a) | The Above Benzotriazole Silver Salt Emulsion | 10 g |
| (b) | Silver Chlorobromide Emulsion | 20 g |
| (c) | Water | 3.5 ml |
| (d) | 0.04% Methanol Solution of a Sensitizing Dye to be shown hereinafter | 4 ml |
| (e) | Dispersion of Dye-providing Substance (1) | 33 g |
| (f) | 5% Aqueous Solution of a compound of the following structure: | 5 ml |

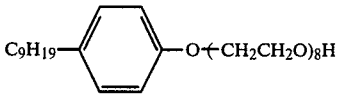

| | | |
|---|---|---|
| (g) | 10% Ethanol Solution of Guanidine-trichloroacetic Acid | 12.5 ml |
| (h) | 10% Aqueous Solution of Dimethylsulfamide | 4 ml |

The above-described components (a) to (h) were mixed and dissolved, then coated in a wet thickness of 30 μm on a polyethylene terephthalate film and dried. Further, a solution prepared by mixing the following components was coated in a wet thickness of 25 μ and dried to prepare a light-sensitive material.

| | | |
|---|---|---|
| (i) | 10% Gelatin Aqueous Solution | 35 g |
| (ii) | 10% Ethanol Solution of Guanidine-trichloroacetic Acid | 5 ml |
| (iii) | 1% Aqueous Solution of Sodium 2-Ethyl-Hexyl Sulfosuccinate | 4 ml |
| (iv) | 4% Aqueous Solution of $CH_2{=}CHSO_2{-}CH_2NHCO(CH_2)_3NHCOCH_2SO_2CH{=}CH_2$ | 3 ml |
| (v) | Water | 53 ml |

A dye fixing material was prepared as follows.

10 g of poly(methyl acrylate-co-N,N,N-trimethyl-N-vinylbenzylammonium chloride) (ratio of methyl acrylate to vinylbenzylammonium chloride being 1/1) was dissolved in 200 ml of water, and uniformly mixed with 100 g of 10% lime-processed gelatin. This solution was uniformly coated in a wet thickness of 90 μm on a paper support laminated with polyethylene containing dispersed therein titanium dioxide. After drying, the sample was used as a dye fixing material having a mordant layer.

The above-described light-sensitive material, i.e., both the fresh one immediately after preparation, and one having been stored at 50° C. for one day, were imagewise exposed for 10 seconds at 2000 lux through a two-color separation filter for blue light and infrared light constituted by SP-1 filter and SC-72 filter (made by Fuji Photo Film Co., LTd.) using a tungsten lamp, followed by uniformly heating it for 30 seconds on a 130° C. heat block.

Then, after dipping the dye fixing material in water, the above-described light-sensitive materials having been heated were superposed thereon with the coated surface in contact with each other. The resulting assemblies were heated for 6 seconds on a 80° C. heat block. Upon peeling the dye fixing material from the light-sensitive material, negative cyan images shown in the following table were obtained on the dye fixing material.

| Sensitizing Dye | Relative Sensitivity*1 | Desensitization after one-day standing at 50° C. (Δlog E)*2 |
|---|---|---|
| 1* | 0 | −0.5 |
| 2* | −0.6 | −0.8 |
| 3* | −0.4 | −1.2 |
| 4* | 0.1 | −1.4 |
| I-1** | 0.1 | −0.1 |
| I-2** | −0.2 | 0 |
| I-9** | 0.2 | 0 |
| I-15** | −0.1 | −0.1 |
| I-18** | 0.3 | 0 |
| II-1** | −0.4 | −0.2 |

-continued

| Sensitizing Dye | Relative Sensitivity*[1] | Desensitization after one-day standing at 50° C. (Δlog E)*[2] |
|---|---|---|
| II-2** | −0.2 | −0.1 |

*conventional dyes;

**dyes of the present invention

*[1]The term "relative sensitivity" as used herein means a relative value of logarithm of reciprocal of an enough infrared light exposure amount to obtain the density of minimum density + 0.5, taking that of light-sensitive material containing the sensitizing dye 1 as 1.

[2]The phrase "desensitization after one-day standing at 50° C." means the difference in relative sensitivity between the fresh light-sensitive material and the same light-sensitive material having been left for one day at 50° C.

1. 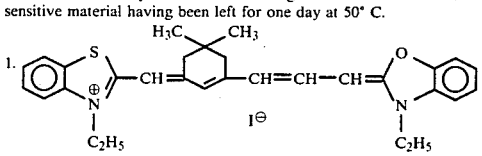

2. 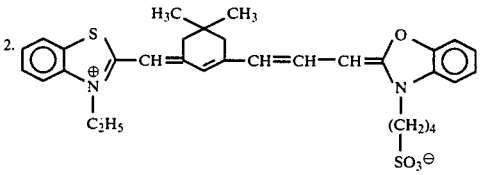

3. 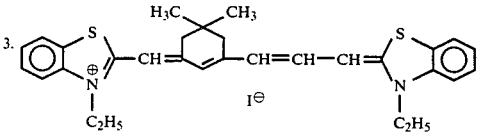

4. 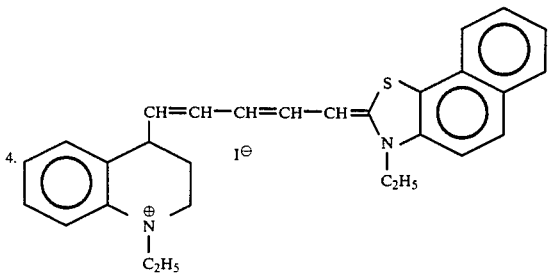

Additionally, structural formulae of sensitizing dyes used in the samples according to the present invention have been set forth hereinbefore.

While the present invention has been described in detail and with reference to specific embodiments thereof, it is apparent to one skilled in the art that various changes and modifications can be made therein without departing from the spirit and scope of the present invention.

What is claimed is:

1. A heat developable light-sensitive material which is sufficiently stable to be stored for a long time at a predetermined sensitivity, comprising a light-sensitive silver halide spectrally sensitized with a dye represented by formula (I) or (II):

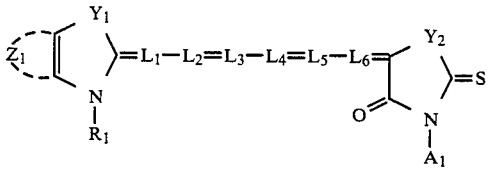

(I)

wherein $R_1$ represents an alkyl group or a substituted alkyl group, $A_1$ represents an alkyl group, a substituted alkyl group, a phenyl group, a substituted phenyl group, a pyridyl group, or a substituted pyridyl group, $Y_1$ represents an oxygen atom, a sulfur atom, a selenium atom,

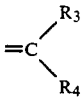

(wherein $R_3$ and $R_4$ each represents a methyl group or an ethyl group), =N—$R_5$ (wherein $R_5$ represents an alkyl group or a substituted alkyl group containing not more than 5 carbon atoms, or an allyl group), or —CH=CH—, $Y_2$ represents an oxygen atom, a sulfur atom, or =N—$A_2$, (wherein $A_2$ represents an alkyl or substituted alkyl group containing not more than 5 carbon atoms, an allyl group, a phenyl group, a substituted phenyl group, a pyridyl group, or a substituted pyridyl group), $Z_1$ represents atoms forming an unsubstituted or substituted benzene or naphthalene ring; and $L_1$ through $L_6$ each represents a methine or substituted methine group, wherein $L_2$ and $L_4$ or $L_4$ and $L_6$ can bonded to each other to form a 5- or 6-membered ring;

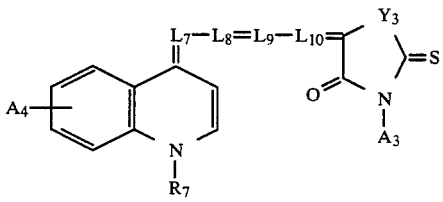

(II)

wherein $Y_3$, $R_7$, and $A_3$ represent the same atoms or groups as defined for $Y_2$, $R_1$, and $A_1$, respectively;

$A_4$ represents an alkyl group containing from 1 to 4 carbon atoms, a halogen atom, a phenyl group, a hydroxyl group, an alkoxy group containing from 1 to 4 carbon atoms, a carboxyl group, an alkoxycarbonyl group, an alkylsulfamoyl group, an alkylcarbamoyl group, an acyl group, a cyano group, a trifluoromethyl group, or a nitro group; and $L_7$ through $L_{10}$ each represents a methine or substituted methine group, wherein the substituent is an alkyl group, a substituted alkyl group, an aryl group, or an alkoxy group, wherein said material further comprises at least one of a compound being capable of releasing a mobile dye corresponding to or inversely corresponding to the reduction of silver halide to silver at elevated temperatures and an alkali or alkali precursor.

2. A heat developable light-sensitive material as claimed in claim 1, wherein an amount of the alkali or alkali precursor is not more than 50 wt% based on the weight of a dried coating of the light-sensitive material.

3. A heat developable light-sensitive material as claimed in claim 2, wherein the amount of the alkali or alkali precursor is from 0.01 wt% to 40 wt% based on the weight of a dried coating of the light-sensitive material.

4. A heat developable light-sensitive material as claimed in claim 2, said compound is represented by formula (CI)

$$(\text{Dye-X})_q\text{-Y} \qquad \text{(CI)}$$

wherein

Dye represents a dye moiety which, when released from the molecule, has a diffusibility different from that of $(\text{Dye-X})_q$-Y;

q represents 1 or 2;

X represents a mere bond or a linking group; and

Y represents a group which releases Dye corresponding to or inversely corresponding to light-sensitive silver salt having imagewise latent image to cause difference in diffusibility between the released dye and the compound represented by $(\text{Dye-X})_q$-Y.

5. A heat developable light-sensitive material as claimed in claim 4, wherein an amount of the compound is from 0.01 to 4 mol per mol of silver halide.

6. A heat developable light-sensitive material as claimed in claim 1, wherein an amount of the dye is from $10^{-8}$ to $10^{-2}$ mol per mol of silver halide.

7. A heat developable light-sensitive material as claimed in claim 6, wherein the amount of the dye is from $10^{-7}$ to $10^{-4}$ mol per mol of silver halide.

* * * * *